US010866008B1

(12) United States Patent
Notarianni

(10) Patent No.: US 10,866,008 B1
(45) Date of Patent: Dec. 15, 2020

(54) HVAC REGISTER BOOT-MOUNTING SYSTEM

(71) Applicant: Vincent Notarianni, Bradenton, FL (US)

(72) Inventor: Vincent Notarianni, Bradenton, FL (US)

( * ) Notice: Subject to any disclaimer, the term of this patent is extended or adjusted under 35 U.S.C. 154(b) by 358 days.

(21) Appl. No.: 16/018,236

(22) Filed: Jun. 26, 2018

(51) Int. Cl.
*F24F 13/08* (2006.01)
*F24F 13/02* (2006.01)

(52) U.S. Cl.
CPC ..... *F24F 13/084* (2013.01); *F24F 13/0209* (2013.01); *F24F 13/0254* (2013.01)

(58) Field of Classification Search
CPC . F16L 43/001; F24F 13/0209; F24F 13/0254; F24F 3/084; H02G 3/105; H02G 23/123
USPC ..... 454/230, 284–332, 260; 428/582; 174/491–502
See application file for complete search history.

(56) References Cited

U.S. PATENT DOCUMENTS 2,679,796 A 6/1954 Vernon
3,988,030 A 10/1976 Twedell
4,292,276 A 9/1981 Enomoto
5,338,255 A * 8/1994 Akehurst ..... F24F 13/06 248/27.1
5,338,256 A * 8/1994 Tonna ..... F24F 13/06 454/300
5,393,106 A 2/1995 Schroeder
D475,131 S 5/2003 Pilger
8,963,023 B2 * 2/2015 Phillips ..... H02G 3/20 174/542
2008/0045137 A1 * 2/2008 Rosal ..... F24F 13/0245 454/292
2014/0049040 A1 2/2014 Jefferson

FOREIGN PATENT DOCUMENTS

CA 2823760 2/2014

* cited by examiner

*Primary Examiner* — Vivek K Shirsat
(74) *Attorney, Agent, or Firm* — Kyle A. Fletcher, Esq.

(57) ABSTRACT

The HVAC register boot-mounting system is a register boot comprising a left clamp and a right clamp. The left and right clamps may be moved to a first position where they do not extend outside of the envelope of the boot so that the boot may be installed into a hole. A plurality of flanges limit the depth of the insertion. The left and right clamps may then be pivoted to a second position where each clamp extends outside of the boot, clamping drywall around the hole between the plurality of flanges and the clamps. An HVAC duct may be coupled to a duct connector on the top of the boot and a vent may be inserted into an aperture on the bottom of the boot. The presence of the vent prevents the clamps from pivoting back to the first position.

19 Claims, 4 Drawing Sheets

HVAC REGISTER BOOT-MOUNTING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of heating, ventilation, and air conditioning, more specifically, an HVAC register boot-mounting system.

SUMMARY OF INVENTION

The HVAC register boot-mounting system is a register boot comprising a left clamp and a right clamp. The left and right clamps may be moved to a first position where they do not extend outside of the envelope of the boot so that the boot may be installed into a hole. A plurality of flanges limit the depth of the insertion. The left and right clamps may then be pivoted to a second position where each clamp extends outside of the boot, clamping drywall around the hole between the plurality of flanges and the clamps. An HVAC duct may be coupled to a duct connector on the top of the boot and a vent may be inserted into an aperture on the bottom of the boot. The presence of the vent prevents the clamps from pivoting back to the first position.

An object of the invention is to provide a boot for mounting an HVAC vent or register.

Another object of the invention is to provide a pair of clamps on each side of the boot for holding the boot in place on a ceiling or wall.

A further object of the invention is to provide a pair of clamps that may be pivoted to a first position where they do not extend outside of the boot.

Yet another object of the invention is to provide a pair of clamps that may be pivoted to a second position where they extend outside of the boot and clamp the boot into place.

These together with additional objects, features and advantages of the HVAC register boot-mounting system will be readily apparent to those of ordinary skill in the art upon reading the following detailed description of the presently preferred, but nonetheless illustrative, embodiments when taken in conjunction with the accompanying drawings.

In this respect, before explaining the current embodiments of the HVAC register boot-mounting system in detail, it is to be understood that the HVAC register boot-mounting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the HVAC register boot-mounting system.

It is therefore important that the claims be regarded as including such equivalent construction insofar as they do not depart from the spirit and scope of the HVAC register boot-mounting system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
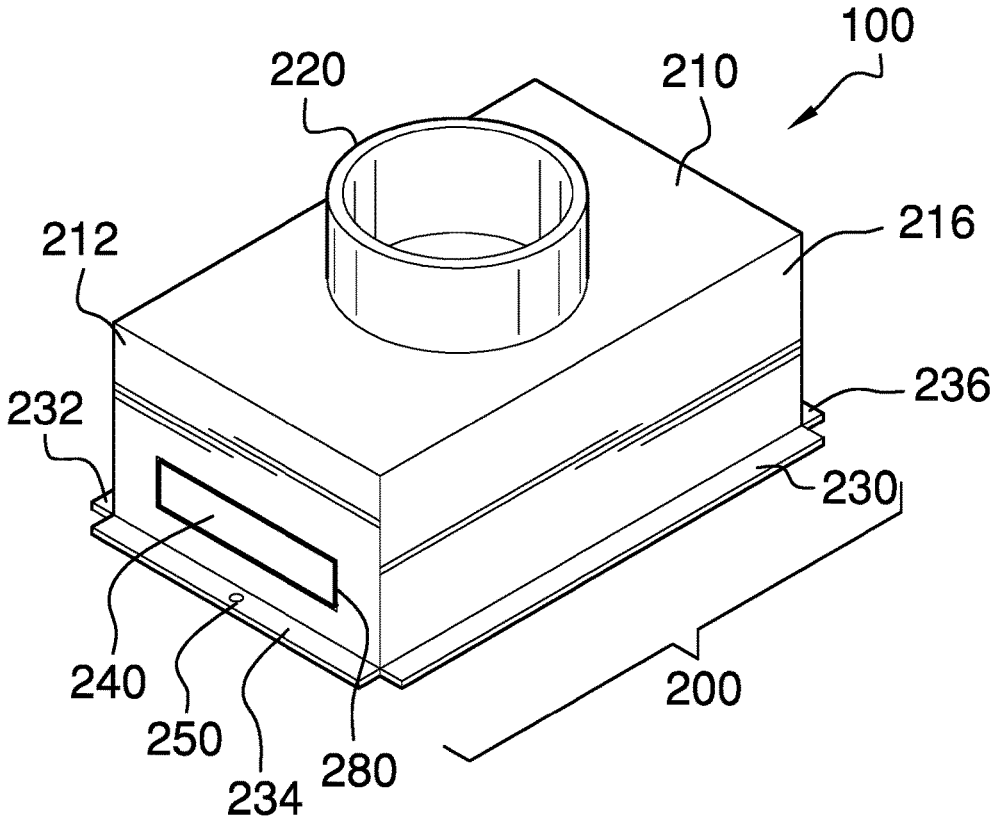
FIG. 1 is a front perspective view of an embodiment of the disclosure illustrating the clamps in the first position.
Figure 2:
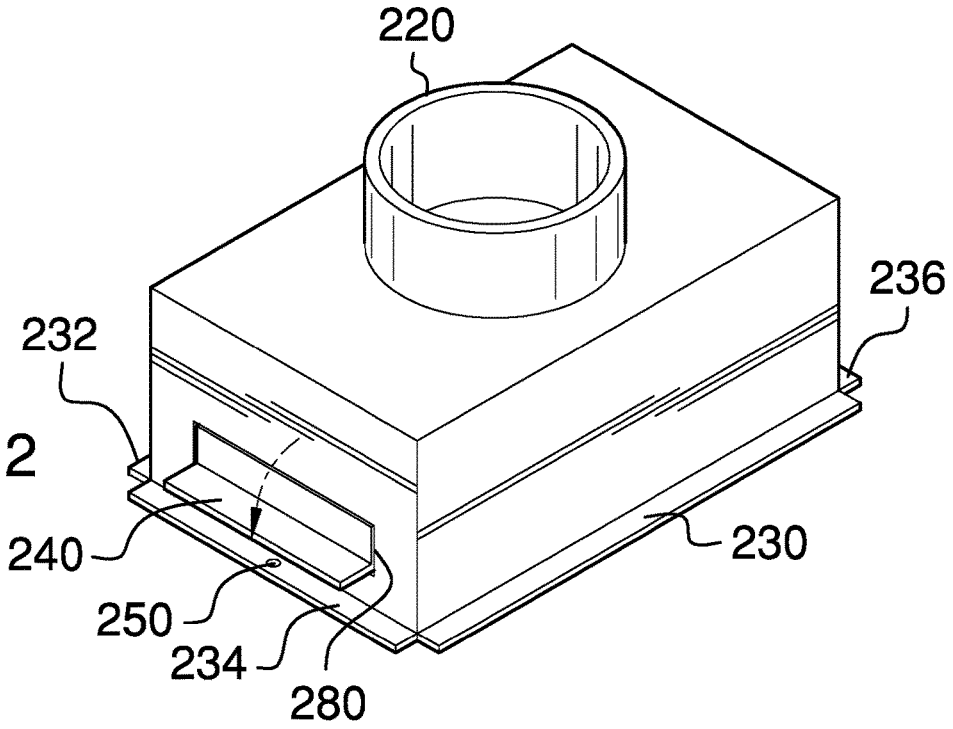
FIG. 2 is a front perspective view of an embodiment of the disclosure illustrating the clamps in the second position.
Figure 3:
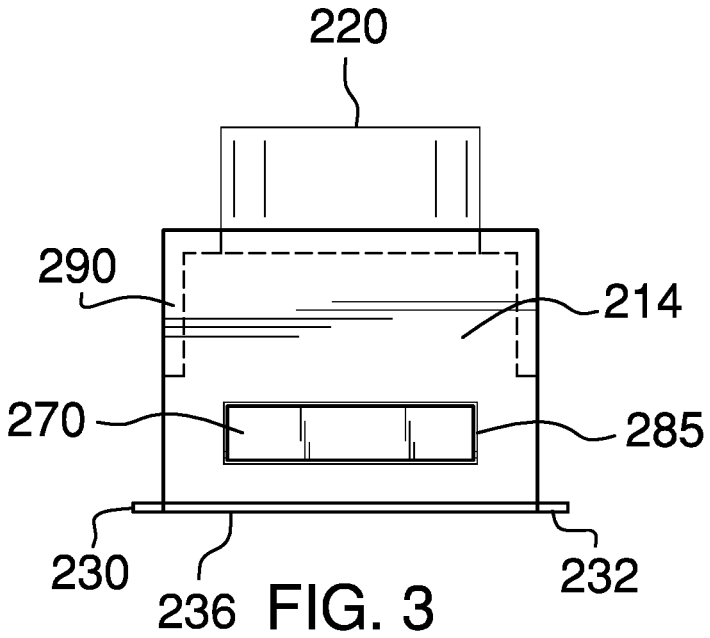
FIG. 3 is a right side view of an embodiment of the disclosure.
Figure 4:
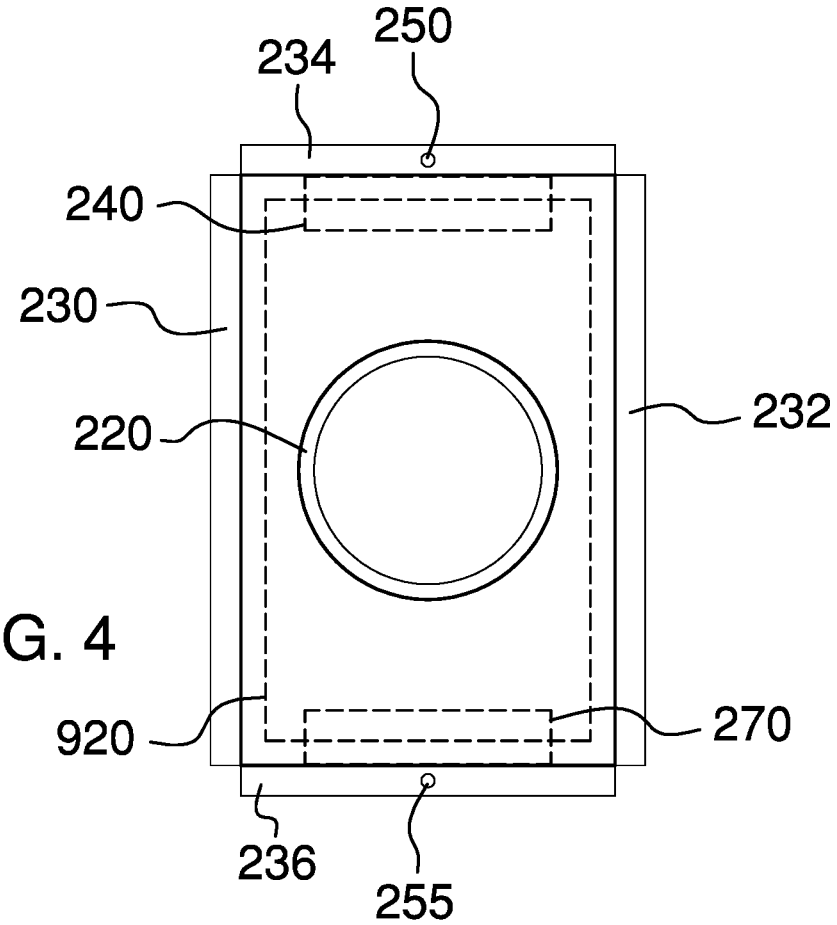
FIG. 4 is a top view of an embodiment of the disclosure.
Figure 5:
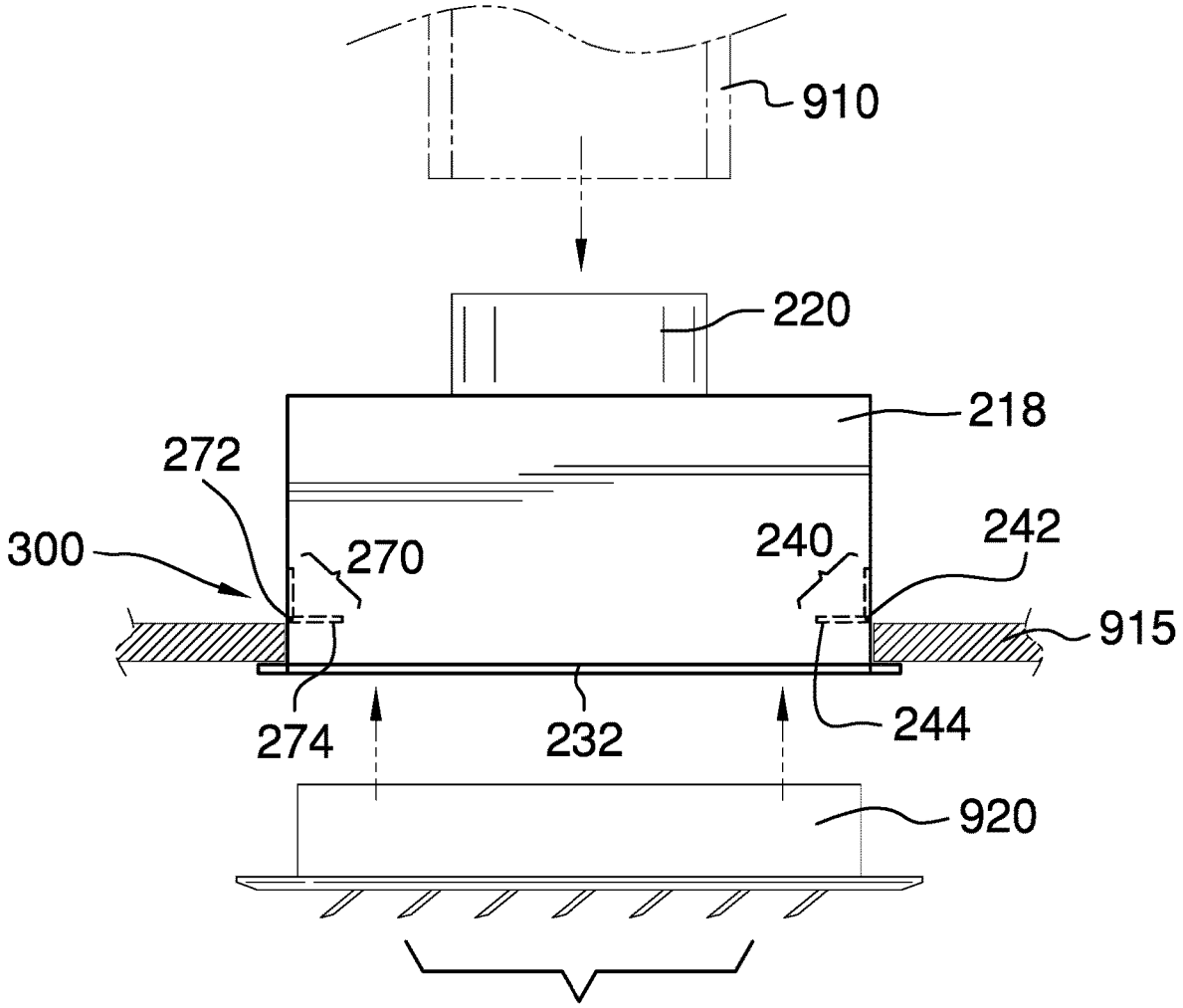
FIG. 5 is a rear detail view of an embodiment of the disclosure illustrating installation of the boot.
Figure 6:
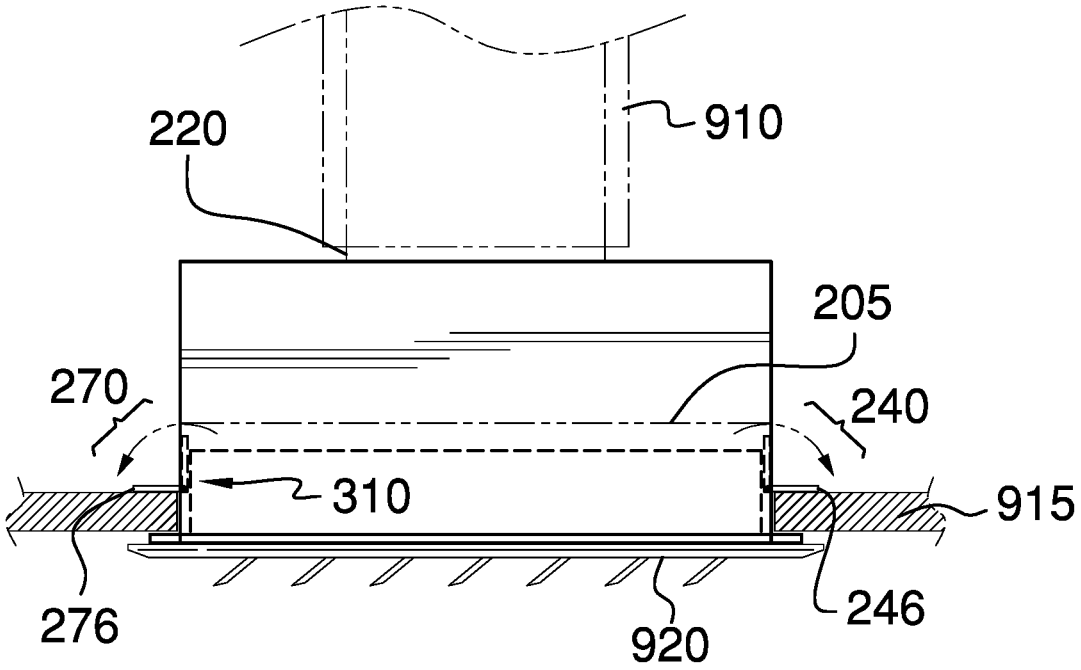
FIG. 6 is a rear detail view of an embodiment of the disclosure illustrating attachment of the duct and the vent.

Detailed reference will now be made to a first potential embodiment of the disclosure, which is illustrated in FIGS. 1 through 6.

The HVAC register boot-mounting system 100 (hereinafter invention) comprises a left clamp 240, a right clamp 270, and a boot 200. The boot 200 may be installed into a rectangular hole in a ceiling by pivoting the left clamp 240 and the right clamp 270 to a first position 300 and placing the boot 200 into the rectangular hole. The left clamp 240 and the right clamp 270 may then be pivoted to a second position 310 to clamp onto drywall 915 surrounding the rectangular hole. An air vent 920 installed in the boot 200 may hold the left clamp 240 and the right clamp 270 in the second position 310.

Through this document, the invention 100 is described in an orientation where it would be installed into the rectangular hole in the ceiling with the air vent 920 installed on the bottom of the boot 200. The invention 100 is not limited to installation in the ceiling and may be installed in a wall in either portrait or landscape orientations.

The left clamp 240 may be an L-shaped armature comprising a left inside edge 244, a left outside edge 246, and a left pivot axis 242. The left clamp 240 may be mounted within a left clamp aperture 280 located on the left side of the boot 200. The left clamp aperture 280 may be a rectangular opening in a left wall 212 that runs from front to rear. The left clamp 240 may be pivotably coupled to the left wall 212 of the boot 200 such that the left pivot axis 242 is oriented horizontally.

When the left clamp 240 is pivoted to the first position 300, the left inside edge 244 moves into the interior of the boot 200 and the left outside edge 246 moves to a position above the left pivot axis 242, within the plane of the left wall 212. When the left clamp 240 is in the first position 300, the left side of the boot 200 is clear of obstructions and may slide into the rectangular hole until stopped by a left flange 234.

When the left clamp 240 is in the second position 310, the left inside edge 244 moves to a position above the left pivot axis 242, within the plane of the left wall 212, and the left outside edge 246 moves to a position outside of the boot 200. When the left clamp 240 is pivoted to the second position 310, the left clamp 240 extends to the left of the boot 200 and the drywall 915 may be clamped between the left outside edge 246 of the left clamp 240 and the left flange 234, preventing movement of the left side of the boot 200 through the rectangular hole in either direction.

The right clamp 270 may be an L-shaped armature comprising a right inside edge 274, a right outside edge 276, and a right pivot axis 272. The right clamp 270 may be mounted within a right clamp aperture 285 located on the right side of the boot 200. The right clamp aperture 285 may be a rectangular opening in a right wall 214 that runs from front to rear. The right clamp 270 may be pivotably coupled to the right wall 214 of the boot 200 such that the right pivot axis 272 is oriented horizontally.

When the right clamp 270 is pivoted to the first position 300, the right inside edge 274 moves into the interior of the boot 200 and the right outside edge 276 moves to a position above the right pivot axis 272, within the plane of the right wall 214. When the right clamp 270 is in the first position 300, the right side of the boot 200 is clear of obstructions and may slide into the rectangular hole until stopped by a right flange 236.

When the right clamp 270 is in the second position 310, the right inside edge 274 moves to a position above the right pivot axis 272, within the plane of the right wall 214, and the right outside edge 276 moves to a position outside of the boot 200. When the right clamp 270 is pivoted to the second position 310, the right clamp 270 extends to the right of the boot 200 and the drywall 915 may be clamped between the right outside edge 276 of the right clamp 270 and the right flange 236, preventing movement of the right side of the boot 200 through the rectangular hole in either direction.

The boot 200 comprises a top wall 210, a front wall 216, a rear wall 218, the left wall 212, and the right wall 214. The left edge of the front wall 216 may be coupled to the front edge of the left wall 212. The right edge of the front wall 216 may be coupled to the front edge of the right wall 214. The top edge of the front wall 216 may be coupled to the front edge of the top wall 210. The left edge of the rear wall 218 may be coupled to the rear edge of the left wall 212. The right edge of the rear wall 218 may be coupled to the rear edge of the right wall 214. The top edge of the rear wall 218 may be coupled to the rear edge of the top wall 210. The top edge of the left wall 212 may be coupled to the left edge of the top wall 210. The top edge of the right wall 214 may be coupled to the right edge of the top wall 210.

The boot 200 may further comprise a front flange 230, a rear flange 232, the left flange 234, and the right flange 236. The front flange 230, the rear flange 232, the left flange 234, and the right flange 236 may prevent the boot 200 from passing through the rectangular hole when being installed. The front flange 230 may couple to the bottom of the front wall 216 on the outside of the boot 200. The front flange 230 may extend perpendicularly from the front wall 216, pointing to front away from the center of the boot 200. The rear flange 232 may couple to the bottom of the rear wall 218 on the outside of the boot 200. The rear flange 232 may extend perpendicularly from the rear wall 218, pointing to rear away from the center of the boot 200. The left flange 234 may couple to the bottom of the left wall 212 on the outside of the boot 200. The left flange 234 may extend perpendicularly from the left wall 212, pointing to left away from the center of the boot 200. The right flange 236 may couple to the bottom of the right wall 214 on the outside of the boot 200. The right flange 236 may extend perpendicularly from the right wall 214, pointing to right away from the center of the boot 200.

In some embodiments, a portion of the inside of the boot 200 may be lined with insulation 290 in locations where having the insulation 290 would not interfere with the operation of the left clamp 240 and the right clamp 270 and where the insulation 290 would not interfere with the fit of the air vent 920. Specifically, the inside of the boot 200 may be lined with the insulation 290 on the inside surface of the top wall 210, on the inside surface of the left wall 212 above the left clamp 240, on the inside surface of the right wall 214 above the right clamp 270, on the inside surface of the front wall 216 above an insulation plane 205, and on the inside surface of the rear wall 218 above the insulation plane 205. The insulation plane 205 may be an imaginary planar surface that passes through the upper edge of the left clamp 240 and through the upper edge of the right clamp 270.

The top wall 210 may comprise a duct connector 220. The duct connector 220 may be a cylindrical collar extending upwards from the top wall 210. A duct 910 may be coupled to the duct connector 220 to provide the boot 200 with a supply of cooled or heated air.

The air vent 920 may be placed into the bottom of the boot and may be held in placed by a pair of screws driven into a left mounting hole 250 and a right mounting hole 255.

In use, the rectangular hole matching the outside dimensions of the boot 200 is cut in the ceiling and the duct 910 is pulled behind the ceiling to the rectangular hole. The duct 910 may be attached to the duct connector 220 on the top of the boot 200. The left clamp 240 and the right clamp 270 may be moved to the first position 300 and the boot 200 may be pushed into the rectangular hole. The air vent 920 may be inserted into the boot 200, causing the left clamp 240 and the right clamp 270 to move to the second position 310. Finally, screws may be driven into the left mounting hole 250 and the right mounting hole 255 to prevent the air vent 920 from falling out of the boot 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, an "air vent" is a fixture placed at the end of a duct which is used to introduce air into a space or to remove air from a space. The air vent may prevent objects from being placed into the duct, may disperse the air in a wider pattern within the space, and may be decorative. An air vent may comprise baffles to steer the air. An air vent comprising a movable damper may be referred to as a "register". The terms "air vent" and "register" are sometimes used interchangeably.

As used in this disclosure, an "aperture" is an opening in a surface. Aperture may be synonymous with hole, slit, crack, gap, slot, or opening.

As used in this disclosure a "ceiling" refers to either: 1) the superior horizontal surface of a room that is distal from the floor; 2) the superior horizontal surface of a structure; or, 3) the upper limit of a range. A floor and a ceiling can be used to the same structure where the selection depends solely on the point of view of the user. The selection of this definition depends on the context. In situations where the context is unclear the first definition should be used.

As used in this disclosure, a "collar" is a ring like device that is placed around an object.

As used herein, the words "couple", "couples", "coupled" or "coupling", refer to connecting, either directly or indirectly, and does not necessarily imply a mechanical connection.

As used in this disclosure, a "duct" is a tube, pipe, canal or channel through which air is conducted or conveyed.

As used in this disclosure, a "flange" is a protruding rib, edge, or collar that is used to hold an object in place or to attach a first object to a second object.

As used in this disclosure, "HVAC" is an acronym for Heating Ventilation and Air Conditioning and is a general term that refers to the air handling technology used within buildings.

As used in this disclosure, the word "interior" is used as a relational term that implies that an object is located or contained within the boundary of a structure or a space.

As used herein, "portrait" and "landscape" refer to orientations of a rectangular object. In a portrait orientation, the object is taller than it is wide. In a landscape orientation, the object is wider than it is tall.

As used in this disclosure, "orientation" refers to the positioning and/or angular alignment of a first object relative to a second object or relative to a reference position or reference direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A HVAC register boot-mounting system comprising:

a left clamp, a right clamp, and a boot;

wherein the boot is installed into a rectangular hole in a ceiling by pivoting the left clamp and the right clamp to a first position and placing the boot into the rectangular hole;

wherein the left clamp and the right clamp are pivoted to a second position to clamp onto drywall surrounding the rectangular hole;

wherein an air vent installed in the boot holds the left clamp and the right clamp in the second position.

2. The HVAC register boot-mounting system according to claim 1 wherein the left clamp is an L-shaped armature comprising a left inside edge, a left outside edge, and a left pivot axis.

3. The HVAC register boot-mounting system according to claim 2 wherein the left clamp is mounted within a left clamp aperture located on the left side of the boot;

wherein the left clamp aperture is a rectangular opening in a left wall that runs from front to rear.

4. The HVAC register boot-mounting system according to claim 3 wherein the left clamp is pivotably coupled to the left wall of the boot such that the left pivot axis is oriented horizontally.

5. The HVAC register boot-mounting system according to claim 4 wherein when the left clamp is pivoted to the first position, the left inside edge moves into the interior of the boot and the left outside edge moves to a position above the left pivot axis, within the plane of the left wall;

wherein when the left clamp is in the first position, the left side of the boot is clear of obstructions and slides into the rectangular hole until stopped by a left flange.

6. The HVAC register boot-mounting system according to claim 5 wherein when the left clamp is in the second position, the left inside edge moves to a position above the left pivot axis, within the plane of the left wall, and the left outside edge moves to a position outside of the boot;

wherein when the left clamp is pivoted to the second position, the left clamp extends to the left of the boot and the drywall is clamped between the left outside edge of the left clamp and the left flange, preventing movement of the left side of the boot through the rectangular hole in either direction.

7. The HVAC register boot-mounting system according to claim 6 wherein the right clamp is an L-shaped armature comprising a right inside edge, a right outside edge, and a right pivot axis.

8. The HVAC register boot-mounting system according to claim 7 wherein the right clamp is mounted within a right clamp aperture located on the right side of the boot;

wherein the right clamp aperture is a rectangular opening in a right wall that runs from front to rear.

9. The HVAC register boot-mounting system according to claim 8 wherein the right clamp is pivotably coupled to the right wall of the boot such that the right pivot axis is oriented horizontally.

10. The HVAC register boot-mounting system according to claim 9 wherein when the right clamp is pivoted to the first position, the right inside edge moves into the interior of the boot and the right outside edge moves to a position above the right pivot axis, within the plane of the right wall;

wherein when the right clamp is in the first position, the right side of the boot is clear of obstructions and slides into the rectangular hole until stopped by a right flange.

11. The HVAC register boot-mounting system according to claim 10 wherein when the right clamp is in the second position, the right inside edge moves to a position above the right pivot axis, within the plane of the right wall, and the right outside edge moves to a position outside of the boot;

wherein when the right clamp is pivoted to the second position, the right clamp extends to the right of the boot and the drywall is clamped between the right outside edge of the right clamp and the right flange, preventing movement of the right side of the boot through the rectangular hole in either direction.

12. The HVAC register boot-mounting system according to claim 11 wherein the boot comprises a top wall, a front wall, a rear wall, the left wall, and the right wall;

wherein the left edge of the front wall is coupled to the front edge of the left wall;

wherein the right edge of the front wall is coupled to the front edge of the right wall;

wherein the top edge of the front wall is coupled to the front edge of the top wall;

wherein the left edge of the rear wall is coupled to the rear edge of the left wall;

wherein the right edge of the rear wall is coupled to the rear edge of the right wall;

wherein the top edge of the rear wall is coupled to the rear edge of the top wall;

wherein the top edge of the left wall is coupled to the left edge of the top wall;

wherein the top edge of the right wall is coupled to the right edge of the top wall.

13. The HVAC register boot-mounting system according to claim 12 wherein the boot comprises a front flange, a rear flange, the left flange, and the right flange;

wherein the front flange, the rear flange, the left flange, and the right flange prevent the boot from passing through the rectangular hole when being installed.

14. The HVAC register boot-mounting system according to claim 13 wherein the front flange couples to the bottom of the front wall on the outside of the boot;

wherein the front flange extends perpendicularly from the front wall, pointing to front away from the center of the boot;

wherein the rear flange couples to the bottom of the rear wall on the outside of the boot;

wherein the rear flange extends perpendicularly from the rear wall, pointing to rear away from the center of the boot.

15. The HVAC register boot-mounting system according to claim 14 wherein the left flange couples to the bottom of the left wall on the outside of the boot;

wherein the left flange extends perpendicularly from the left wall, pointing to left away from the center of the boot;

wherein the right flange couples to the bottom of the right wall on the outside of the boot;

wherein the right flange extends perpendicularly from the right wall, pointing to right away from the center of the boot.

16. The HVAC register boot-mounting system according to claim 15 wherein a portion of the inside of the boot is lined with insulation in locations where having the insulation would not interfere with the operation of the left clamp and the right clamp and where the insulation would not interfere with the fit of the air vent.

17. The HVAC register boot-mounting system according to claim 16 wherein the inside of the boot is lined with the insulation on the inside surface of the top wall, on the inside surface of the left wall above the left clamp, on the inside surface of the right wall above the right clamp, on the inside surface of the front wall above an insulation plane, and on the inside surface of the rear wall above the insulation plane;

wherein the insulation plane is an imaginary planar surface that passes through the upper edge of the left clamp and through the upper edge of the right clamp.

18. The HVAC register boot-mounting system according to claim 15 wherein the top wall comprises a duct connector;

wherein the duct connector is a cylindrical collar extending upwards from the top wall;

wherein a duct is coupled to the duct connector to provide the boot with a supply of cooled or heated air.

19. The HVAC register boot-mounting system according to claim 18 wherein the air vent is placed into the bottom of the boot and is held in placed by a pair of screws driven into a left mounting hole and a right mounting hole.

* * * * *